United States Patent [19]

Fukamizu et al.

[11] 4,149,674

[45] Apr. 17, 1979

[54] DECORATIVE APPARATUS

[76] Inventors: Tadashi Fukamizu; Kazue Fukamizu, both of No. 6-6, Fukuzumidori 6-chome, Nada-ku, Kobe-shi, Hyogo-ken, Japan

[21] Appl. No.: 748,172

[22] Filed: Dec. 7, 1976

[30] Foreign Application Priority Data

Mar. 3, 1976 [JP] Japan ..... 51-23905

[51] Int. Cl.[2] ..... B05B 17/08

[52] U.S. Cl. ..... 239/20; 239/590.3

[58] Field of Search ..... 239/22, 23, 17, 20, 239/590.3, 18

[56] References Cited

U.S. PATENT DOCUMENTS

| | | | |
|---|---|---|---|
| 2,531,002 | 11/1950 | Sisk et al. | 239/17 |
| 3,174,688 | 3/1965 | Chatten | 239/20 |
| 3,428,258 | 2/1969 | Duggan | 239/590.3 |
| 3,451,622 | 6/1969 | Forney | 239/23 X |
| 3,630,455 | 12/1971 | Parkison | 239/590.3 X |
| 3,820,715 | 6/1974 | Hamilton | 239/17 |

*Primary Examiner*—Kenneth H. Betts
*Assistant Examiner*—Michael Mar
*Attorney, Agent, or Firm*—Armstrong, Nikaido, Marmelstein & Kubovcik

[57] ABSTRACT

A decorative apparatus making use of a filmy flow of fluid, which comprises: an outlet having an outlet box containing a rectifying member for regularizing a fluid, the outlet box being formed with an outlet hole at the bottom thereof for pouring down the regularized fluid therethrough; an expanding member for transforming the poured fluid into a filmy flow of fluid, which is located beneath and opposing to the outlet hole; a feed device for supplying the outlet with the fluid; and a supporting apparatus for supporting the outlet and the expanding member and for storing the fluid. The fluid which is regularized by the rectifying member contained in the outlet box and thereafter poured through the outlet hole, is spread on the expanding member and forms itself into a stable and three dimensional filmy flow of fluid such as a globe, spheroid, or parasol.

23 Claims, 52 Drawing Figures

FIG.1
PRIOR ART
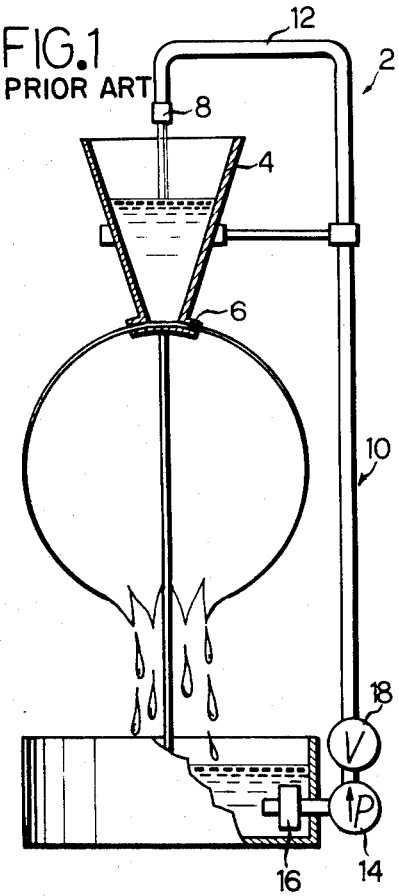
FIG.2
PRIOR ART
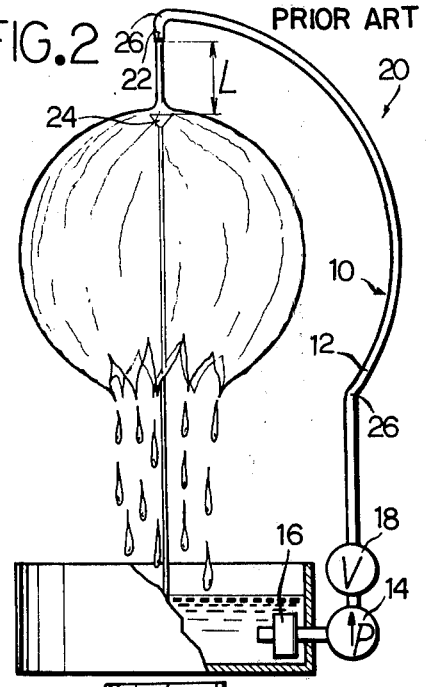
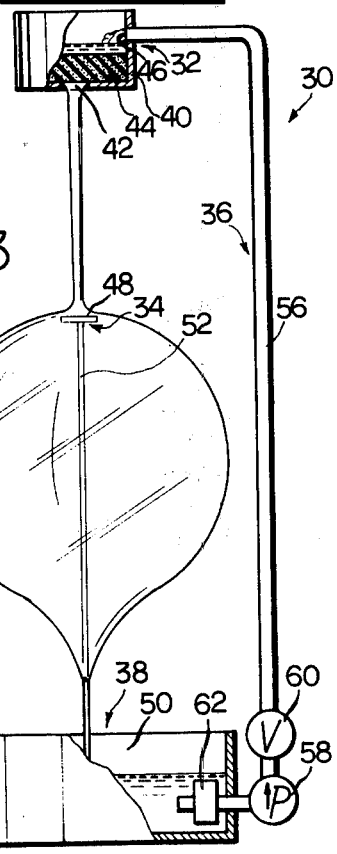
FIG.3

34a
52a
F1
32
96
102
40Bd
WL
40Bb
98a
40Ba
40Aa
90
40
40A
40B
40Bc
98b
40Ab
44
42
100
P
94
92
34b
52b

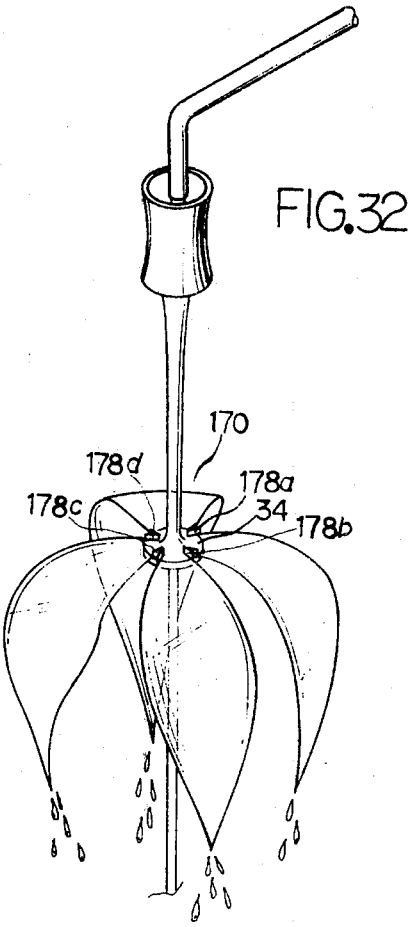
FIG.32
FIG.33
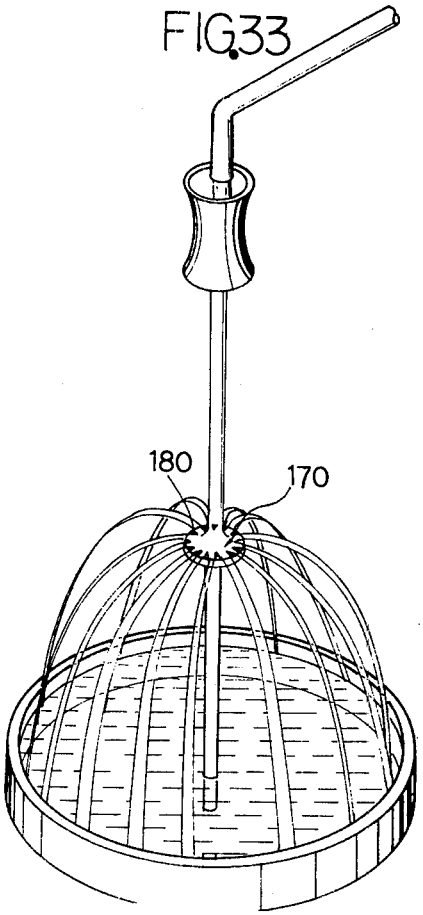
FIG.34
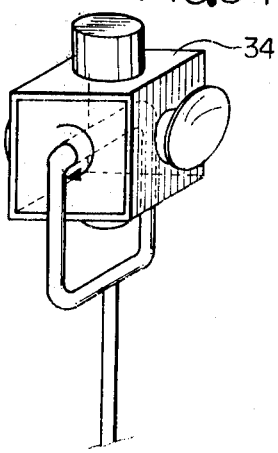
FIG.35
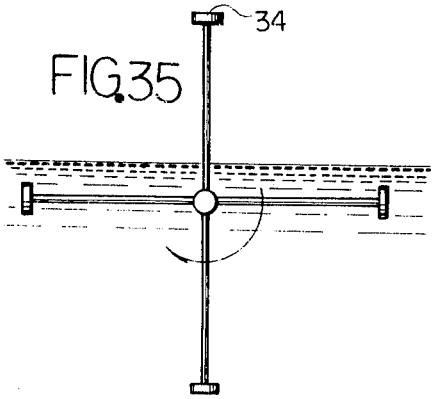

FIG.36
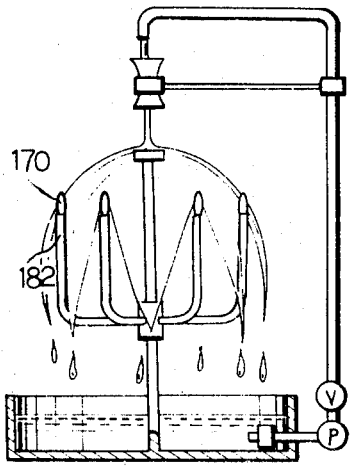
FIG.38
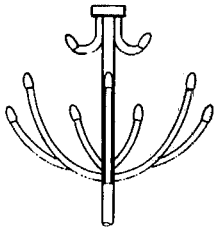
FIG.39
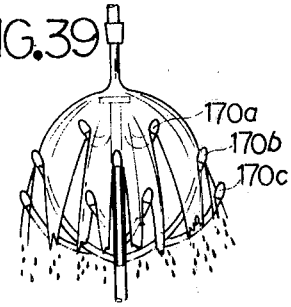
FIG.37(A)
FIG.37(B)
FIG.37(C)
FIG.37(D)
FIG.37(E)
FIG.37(F)
FIG.40
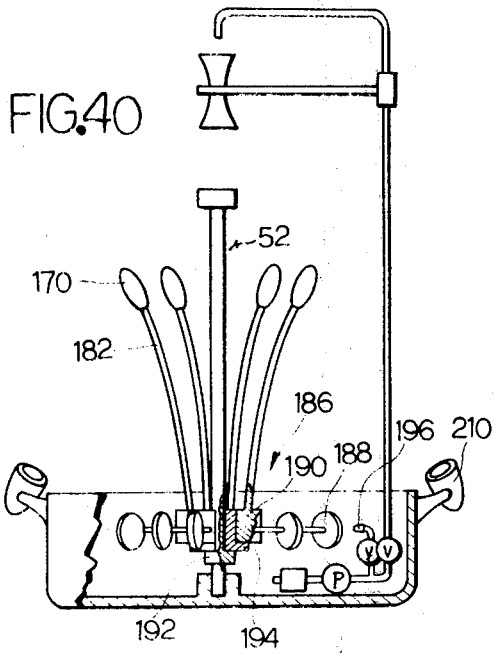

DECORATIVE APPARATUS

BACKGROUND OF THE INVENTION

The present invention relates to a novel and improved decorative apparatus making use of a filmy flow of fluid or membraneous flow of fluid, and more particularly to a decorative apparatus employing a rectifying member in order to get a stable and beautiful filmy flow of fluid (hereinafter referred to as "fluid-film").

In order to obtain a beautiful decorative apparatus which makes use of a fluid-film, it is quite essential to form a stable and transparent fluid-film with uniform thickness and smooth surface as if it were made of glass or the like. And cheapness and easy maintenance are another essential requirements of the decorative apparatus which is preferably usable in restaurants, teahouses or private houses.

One of the previous proposals discloses an apparatus 2, as shown in FIG. 1, comprising a funnel 4 formed with a circular gap 6 of small clearance. A fluid supplied from a nozzle 8 by means of a feed means 10 having a feed pipe 12, pump 14, filter 16 and valve 18, on passing through the circular gap 6, takes a shape of three dimensional fluid-film. However, the apparatus 2 has some disadvantages. The small circular gap 6 is apt to catch a dust and small sand, and is often obstructed by them. Furthermore, in order to obtain a uniformly and suitably separated circular gap 6 for passing through the fluid, it should be very carefully and accurately manufactured, since otherwise stable and beautiful fluid-film is not obtainable as a result the apparatus becomes quite expensive.

In one particular apparatus, shown in FIG. 2, an attempt was made to eliminate the disadvantages of the aforesaid apparatus 2, by substituting a nozzle 22 faced downwardly and connected directly to a feed pipe 12 and an expanding means 24 which is located beneath and opposing to the nozzle 22, for a funnel 4 with circular gap 6 and a nozzle 8 shown in FIG. 1. Although such arrangement in which the fluid is poured onto the expanding means directly from the nozzle 22 through the feed pipe 12, makes it easier to construct the apparatus 20, it is quite difficult to get a stable and beautiful fluid-film with uniform thickness and smooth surface. The fluid-film obtained in such apparatus 20 shown in FIG. 2 is uneven in thickness, rugged in surface, dimmed and breakable. In other words, it is readily turned into a waterdrop and often divided into some pieces. Besides, the conditions such as a distance L between the nozzle 22 and the expanding means 24 and a quantity of fluid per minute, in which the fluid-film (even it is not so beautiful as described before) is obtainable, are extremely limited, as will be evident as the description proceeds.

As a result of careful and steady experiments of many years in order to improve the defects in the aforesaid apparatus 20, the inventors of the present invention found that the foundamental cause of such disadvantages results from a turbulency of the flow of fluid poured from the nozzle 22 onto the expanding means 24 and the turbulency originates from a flow-resistance at the nozzle 22 and the feed pipe 12 (especially at curved or cornered portion 26). They also found that the turbulency of the flow is effectively avoidable by means of an outlet means having an outlet box containing a rectifying member which can regularize the turbulent flow. During the prosecution of the experiments, the inventors found further problems to be dissolved for obtaining a stable and beautiful fluid-film:

Firstly, when the formed fluid-film is in the shape of globe or spheroid, there sometimes occurs curious phenomena. That is, the diameter of the globe or spheroid remains as it is without reference to increasing of amount of fluid per minute, or the fluid-film suddenly diminishes in size and makes thicker, even if the constant quantity of fluid is supplied thereon.

Secondly, the noise and splashes produced at the fluid-line in a tub portion of the supporting means, onto which the lower end of the fluid-film falls, are rather large or much and they should be reduced to minimum.

Thirdly, an air bubble contained in the fluid occasionally breaks the fluid-film, and therefore the air bubble should be removed perfectly from the fluid, if possible.

And the viscosity of fluid is another factor to be necessary for getting a better fluid-film.

The inventors studied out the means which can dissolve the aforesaid problems effectively, in addition to a branching means for consciously modifying or cutting partially the formed fluid-film in order to obtain a better decorative apparatus.

OBJECTS OF THE INVENTION

It is an object of the present invention to provide a novel and improved decorative apparatus making use of a filmy flow of fluid or fluid-film.

Another object of the invention is to provide a decorative apparatus provided with an outlet means having an outlet box containing a rectifying member which can regularize a fluid in order to obtain a beautiful and stable three dimensional fluid-film.

Further object of the invention is to provide a decorative apparatus which is easy in construction and economical in manufacturing.

More further object of the invention is to provide a decorative apparatus provided with a soundproof means for preventing the growth of the noise or splashes of fluid at the fluid-line.

Still further object of the invention is to provide a decorative apparatus having a removing means for removing the air bubble from the fluid poured onto the expanding means.

Further object of the invention is to provide a decorative apparatus equipped with a branching means which can, consciouly, modify or cut partially the formed fluid-film in order to obtain a better fluid-film.

Another object of the invention is to provide a decorative apparatus equipped with a stabilizing means to form a globular or spheroidal fluid-film in size proportioned to the amount of the fluid supplied per minute.

More further object of the invention is to make clear a suitable viscosity of fluid for getting a stable fluid-film.

Another objects and advantages of the invention will be apparent from the following description of the embodiments with reference to the accompanying drawings.

BRIEF DESCRIPTION OF THE DRAWINGS

FIGS. 1 and 2 are partially cutaway side views showing ordinary decorative apparatuses, FIG. 3 is a partially cutaway side view showing a basic embodiment of the present invention, FIGS. 34 and 35 are partial views showing the embodiments of the rotatable expanding means, FIGS. 36 is a partially cutaway side view showing an embodiment of a branching means of the invention, FIGS. 37(A), 37(B), 37(C), 37(D), 37(E) and 37(F) are cross-sectional views showing the examples of the sections of the branching means, FIG. 38 is a diagrammatic partial view showing an embodiment of the branching means, FIG. 39 is a front view showing a fluid-film obtained by the branching means shown in FIG. 38, FIG. 40 is a partially cutaway side view showing an embodiment of a rotating means for rotating the branching means and the expanding means of the invention.

DETAILED DESCRIPTION

Figure 4:
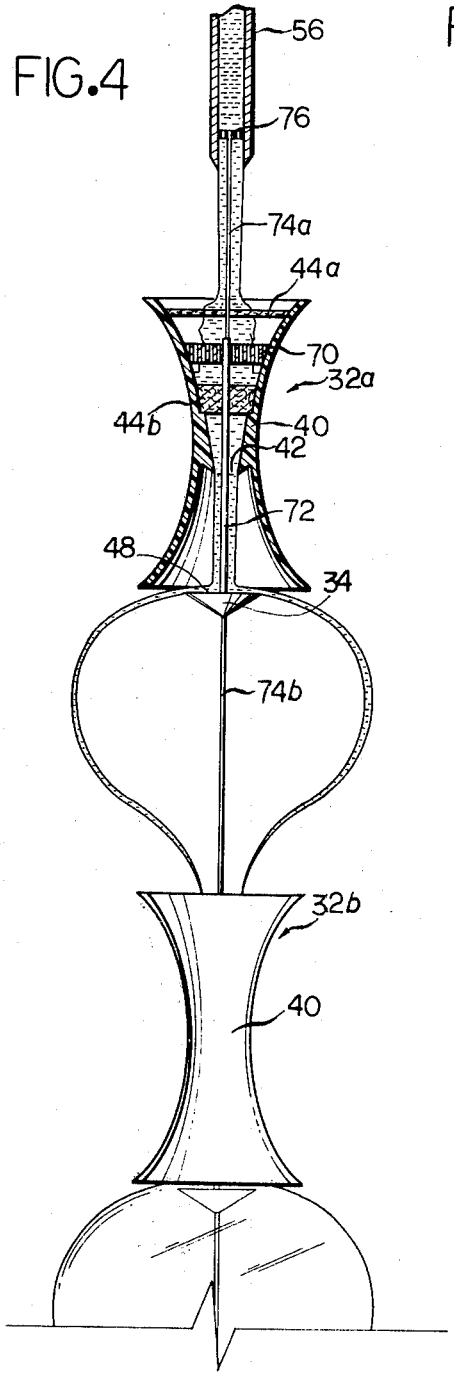
FIG. 4 is a sectional view showing an embodiment of the outlet means of the present invention.

It has been found that the aforesaid objects of the invention can be achieved basically by the decorative apparatus comprising an outlet means having an outlet box containing a rectifying member for regularizing a fluid, the outlet box being formed with an outlet hole at the bottom thereof for pouring down the regularized fluid therethrough; an expanding means for transforming the poured fluid into a filmy flow of fluid, which is located beneath and opposing to the outlet hole; a feed means for supplying the outlet means with fluid; and a supporting means for supporting the outlet means and the expanding means and for storing the fluid.

A basic embodiment of a decorative apparatus 30 of the present invention, according to FIG. 3, comprises an outlet means 32, an expanding means 34, a feed means 36 and a supporting means 38.

The outlet means 32 has an outlet box 40 formed with an outlet hole 42 at the bottom thereof and containing a rectifying member 44, which roll is to regularize a fluid supplied from an inlet hole 46. The regularized fluid is poured down onto the expanding means 34 through the outlet hole 42. The supporting means 38 comprises a tub portion 50 for storing the fluid and a supporting rod 52 for fixing the expanding means 34 thereon. The feed means 36 has a feed pipe 56, one end thereof being attached to the inlet hole 46 of the outlet box 40, and is communicating with the inside of the tub portion 50 through a suitably adjusted pump 58, valve 60 and filter 62.

In operation, the fluid supplied into the outlet box 40 through the inlet hole 46 by means of the feed means 36, soaks into the rectifying member 44 and is regularized, that is, decreased in velocity uniformly.

And the regularized fluid which flows down through the outlet hole 42 gravitationally or without acting any additional force thereon, takes a shape of static and transparent column (as if it were made of glass), the diameter thereof being vertically gradually decreased with the increasement of velocity due to the gravitation and with the surface tension.

As a result, the fluid which is poured down onto the top surface 48 of the expanding means 34 and is spread thereon, formes itself into a three dimensional filmy flow of fluid or fluid-film, such as globe, spheroid or parasolform with smooth surface and uniform thickness. Consequently, the fluid-film formed around the expanding means 34 is stable, transparent, beautiful and sensitive as if it were made of glass or ice.

The fluid gathered in the tub portion 50 of the supporting means 38 is resupplied into the outlet box 40 by means of the feed means 36 and is used cyclically.

For the sake of caution, the basic conception of the invention, as shown in FIG. 3, is obtained from the following facts which were found by the inventors as a result of the experiments carried out prior to the accomplishment of the invention in order to get a beautiful decorative apparatus making use of fluid-film.

A. It is essential to regularize the fluid prior to pouring down from the outlet hole 42 of the outlet box 40 in order to get a stable fluid-film. And the rectifying member is available effectively therefor.

B. One of the suitable material is porous polyurethane foam of approximately 16 mm. ($\frac{5}{8}$ inch) thickness. Of course, another materials are also available for the purpose, as described hereinafter.

C. It is preferable to feed the fluid into the outlet box 40 in such a quantity where the rectifying member is submerged in the fluid.

D. The inner surface of the outlet hole 42 should be round and smooth and should have enough area for passing the aforesaid quantity of fluid.

E. In order to form a symmetrical globular or spheroidal fluid-film, the expanding means should have a round and smooth top surface fixed horizontally and formed with slightly downwardly inclined narrow portion therearound.

The results of the test carried out by the inventors will be clearly described with reference to FIGS. 45(5/5A) to 45(70/10B).

Referring now to FIG. 4, which shows another embodiment of the invention, the outlet means 32*a* comprises a small outlet box 40 in the shape of a long snare drum, formed with an outlet hole 42 at the bottom thereof and a supporting disk 70 which is permeable to fluid and is welded to the inside thereof, and two rectifying members 44*a*, 44*b*, one of them being situated upper the supporting disk 70 and the other one being located beneath it. The expanding means 34, which is in a form of upside-down circular cone has a round top surface 48 for spreading the flow of fluid and for deforming the fluid into a filmy flow of fluid or fluid-film, is supported by means of a supporting rod 72 made of nylon, glass or the like connected to the supporting disk 70. Preferably, the expanding means can hold another outlet means 32*b* through a suitable connecting thread 74*b*.

The outlet means 32*a*, in this embodiment, is hung, for example, at a connecting piece 76 in the feed pipe by means of another connecting thread 74*a*. Another constructions such as feed means can be constructed in the same manner as shown in FIG. 3.

In operation, the fluid supplied from the feed pipe 56 passes through the first rectifying member 44*a*, decreasing the velocity uniformly, and soaks into the second rectifying member 44*b*. Consequently, the fluid is completely regularized and, as a result, a stable and transparent three dimensional fluid-film with uniform thickness and smooth surface as if it were made of glass is obtainable, as mentioned earlier. Preferably, the fluid is gathered at the succeeding outlet means 32*b*.

Figure 5:
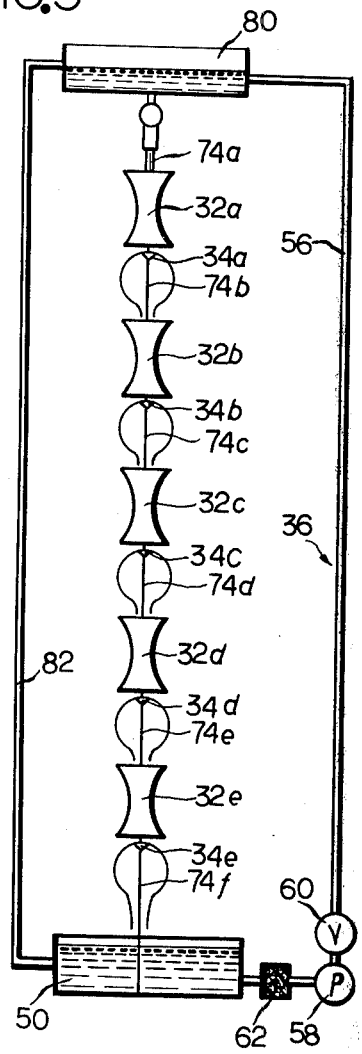
FIG. 5 is a partially sectional schematic side view showing an apparatus employing the outlet means shown in FIG. 4.

FIG. 5 shows an embodiment of the decorative apparatus comprising the outlet means 32*a* to 32*e* and expanding means 34*a* to 34*e* already shown in FIG. 4 which are connected downwardly in serial order by means of suitable connecting threads 74*a* to 74*f*. The feed means 36 has a reserve tank 80 communicating with a feed pipe 56 having a valve 60, pump 58 and filter 62. The fluid poured into the top outlet means 32*a* takes a shape of stable fluid-film at the expanding means 34*a*, and thereafter the fluid is gathered in the second outlet means 32*b* and, similarily, forms another fluid-film on the expanding means 34*b*, and so forth. The reserving tank 80 is preferably provided with an overflow pipe 82 for returning the excessive fluid into the tub portion 50 of the supporting means 38.

Figure 6:
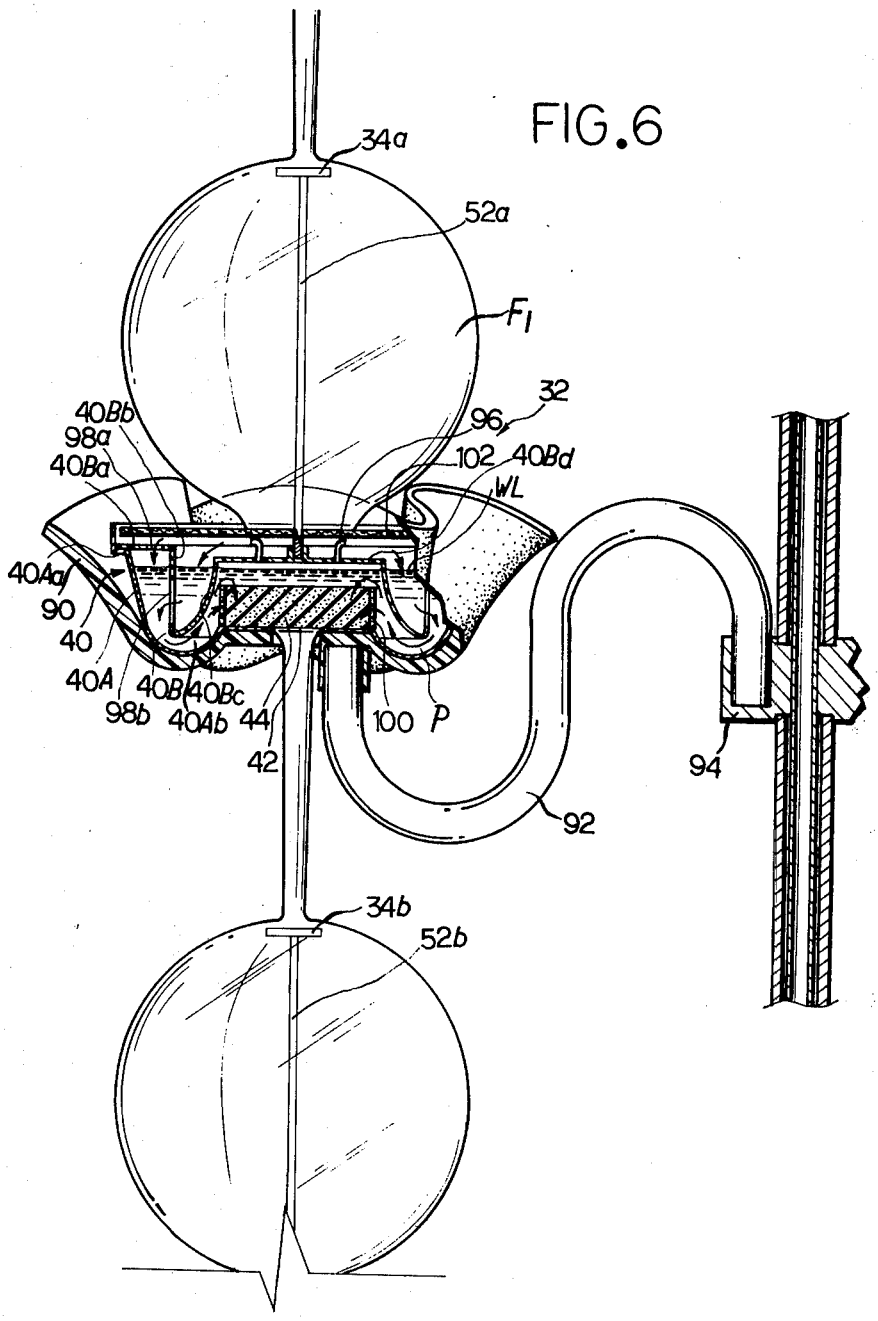
FIG. 6 is a partially sectional view showing an embodiment of the outlet means of the invention.

FIG. 6 shows another embodiment of the outlet means 32, which has an outlet box 40 comprising an outer case 40A and an inner case 40B and which is seated in a bowl 90 which is preferably in a form of a beautiful flower. The bowl 90 is supported by means of a S-shaped arm 92 fixed on a fastening ring 94. The inner case 40B consists of a circular ring 40B*a*, outer wall 40B*b* extending vertically downwardly from the inner end of the circular ring 40B*a*, inner wall 40B*c* extending from the bottom of the outer wall 40B*b* and a center plate 40B*d* equipped with some breather pipe 96 for circulating air. The circular ring 40B*a* and outer wall 40B*b* have piercing holes 98*a*, 98*b* respectively for passing through the fluid. The inner case 40A which is in a shape of cup, is formed with a circular step 40A*a* for supporting the circular ring 40B*a* of the inner case 40B and has relatively deep circular portion 40A*b* to which the deepest portion (between the outer wall 40B*b* and the inner wall 40B*c*) of the inner case 40B is in axial alignment. Therefore, the outer case 40A forms a narrow circular passage P with the inner case 40B for passing the fluid. The outer case 40A contains a rectifying member 44 enclosed with a porous plate 100 and is formed with an outlet hole 42 at the center thereof for pouring down the fluid. The both cases 40A, 40B are covered by a round seat 102 made of porous material which is permeable to fluid. Therefore, similar materials to the rectifying member 44 is available. An expanding means 34*a* is supported on a supporting rod 52*a* which is mounted vertically at the center of the center plate 40B*d* of the inner case 40B.

In operation, the fluid-film formed on the expanding means 34*a* (FIG. 6 shows the case where the fluid poured from the above-located outlet means (not shown) is forming a globular fluid-film Fl) falls onto the round seat 102 without producing any noise and splashes of fluid, owing to soundproof-function and anti-scattering function of the porous material forming the round plate 102. The preferable fluid-line (the rectifying member 44 is submerged in the fluid) is shown by WL in FIG. 6. Gradually, the fluid passes into the outer case 40A through the holes 98*a*, 98*b* and flows into the rectifying member 44 through the narrow circular passage P, and as a result, air bubbles involved in the fluid, which sometimes breaks the fluid-film, are completely cleared. The fluid regularized and uniformed in velocity by means of the rectifying member 44 forms itself into a beautiful and stable fluid-film on the expanding means, as described with reference to FIGS. 3, 4 and 5.

Figure 7:
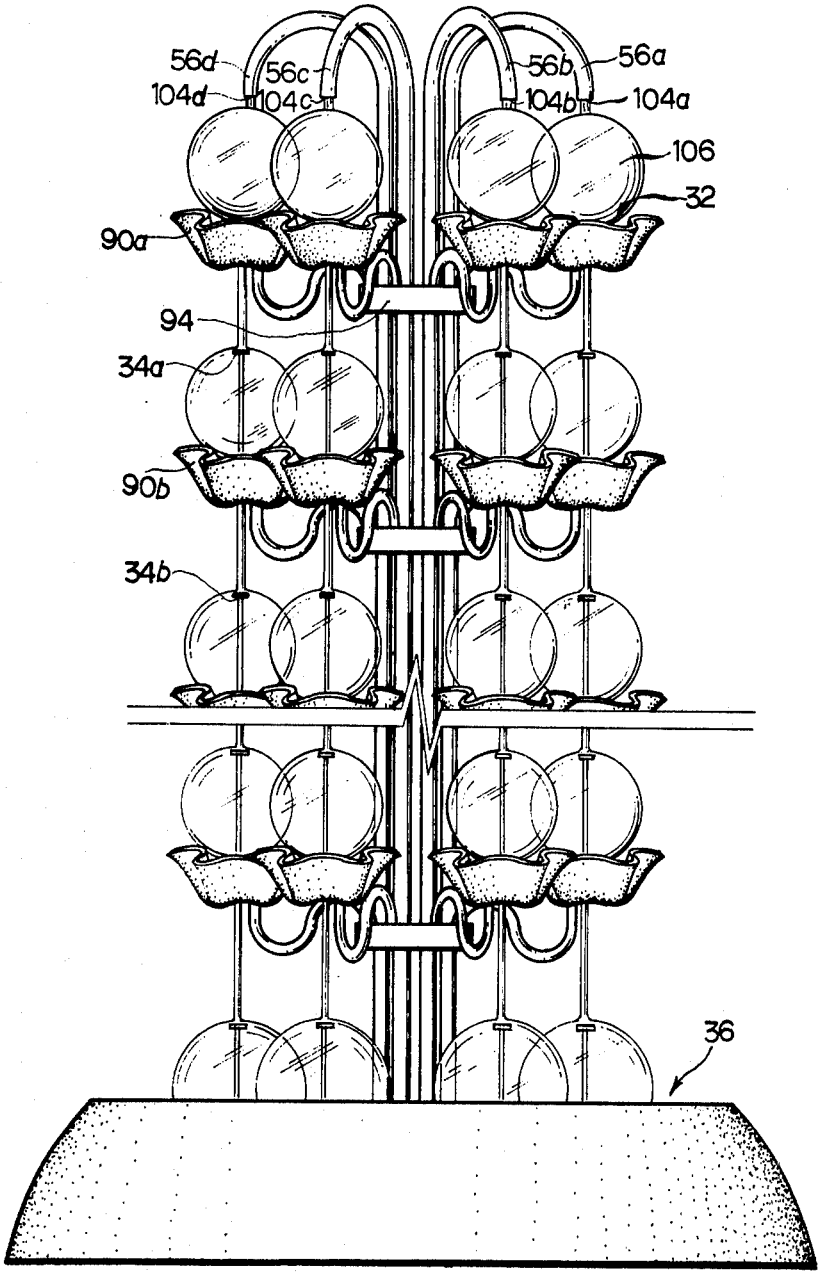
FIG. 7 is a front view of a decorative apparatus employing the outlet means shown in FIG. 6.
Figure 8:
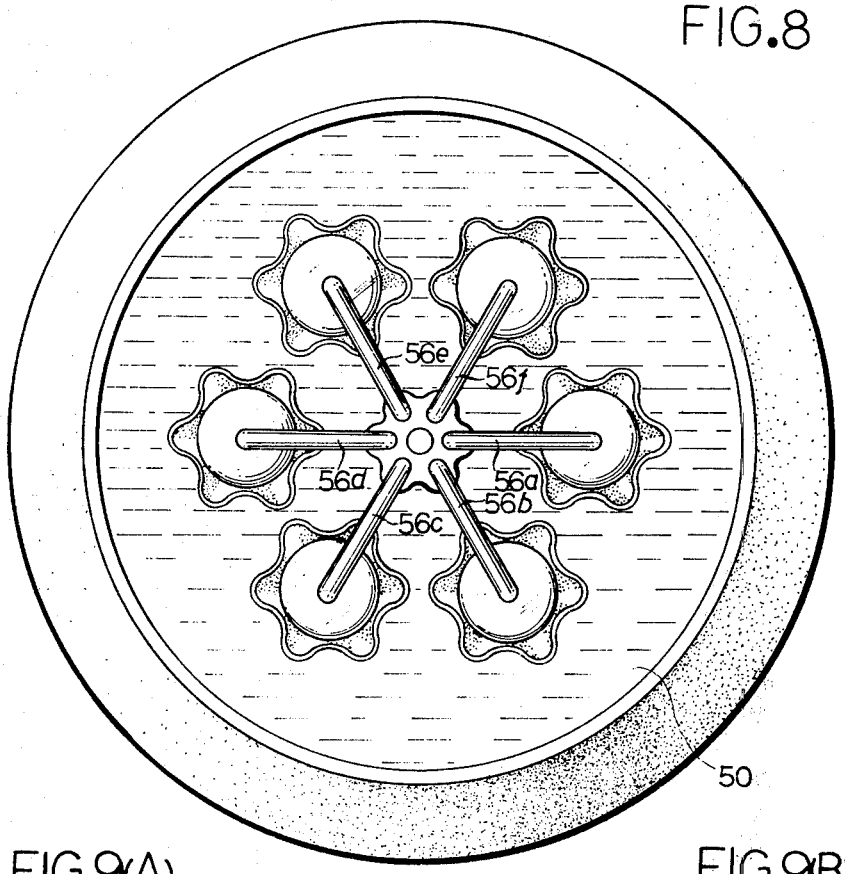
FIG. 8 is a top plan view of the decorative apparatus shown in FIG. 7, FIGS. 9(A), 9(B), 9(C) and 9(D) are sectional views of outlet means of the invention.

FIGS. 7 and 8 show an apparatus employing a number of outlet means 32 shown in FIG. 6. In this embodiment, six feed pipes 56*a* to 56*f* with outlet mouths 104*a* to 104*f* faced vertically downwardly are fixed on the supporting means 38 which has a tub portion 50, the feed pipes being separated each other with almost equal circular pitch and reinforced by some fastening rings 94 which are spaced almost equal longitudinal pitch. The fastening rings 94 fix one end of S-shaped arms 92 supporting the bowl 90 at the other end thereof. Preferably, the feed pipes 56*a* to 56*b* are encircled by means of some glass pipes or the like, for the purpose of decoration.

Similar to the embodiments shown in FIGS. 3, 4 and 5, the feed pipes 56*a* to 56*f* have suitably adjusted pump, filter and valve and communicate with the tub portion 50 of supporting means 38. Preferably the fluid is supplied to the feed pipe through a suitable distributor (not shown). Further, it is preferable in this embodiment to use a real glass-ball 106 only at the top bowls 90*a*, since the fluid is poured directly (not regularized) from the pipe mouths 104*a* to 104*f*. Consequently, when the apparatus is in operation, the fluid which flows down along the surface of glass ball 106 falls onto the round plate 102 of the outlet means 32 in a top bowl 90*a* silently and without producing any fluid-splash, as described already. And the fluid, which is regularized and from which air bubbles are removed perfectly by means of the outlet means 32 having a rectifying member 44 and a narrow passage P, flows through the outlet hole 42 and forms itself into the filmy flow of fluid or fluid-film at the expanding means 34*a*. The fluid is gathered at the second outlet means contained in the second bowl 90*b* and forms succeeding fluid-films. Subsequently, the fluid-film is formed under the each bowl.

With respect to the material of the rectifying member 44, as mentioned earlier, a porous polyurethane foam is preferably available for the rectifying member.

However, without being restricted to the aforesaid material, any materials which are permeable to fluid and can regularize the turbulent flow of fluid, are also available. For example, porous material (such as rubber sponge, synthetic resin sponge, e.g. polyvinyl chloride foam, or natural sponge, etc.), net material (such as metal plate, plastics plate, natural fiber, synthetic fiber, glass fiber, etc. which is knitted, stamped, entangled, bonded, or extruded) or granular material (such as gravel, carbon ball, etc. which is supported by suitable net; or heat-bonded; or adhered) is also available therefor.

Figure 9A:
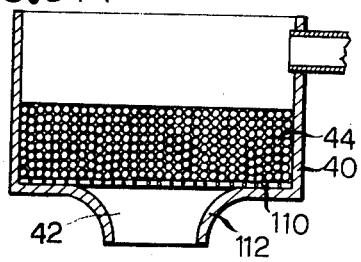
Figure 9B:
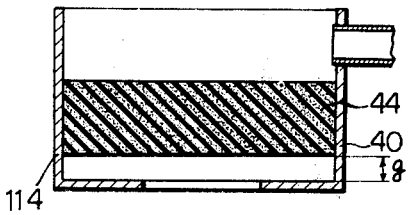
Figure 9C:
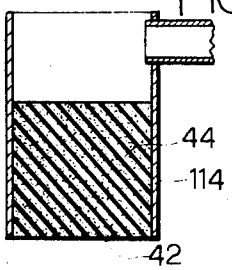
Figure 9D:
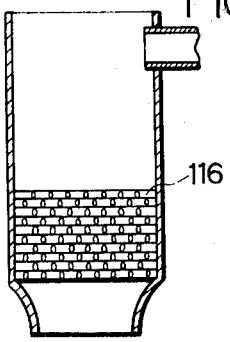

The rectifying member 44 is attachable to the interior of the outlet box 40 in various manner. For example, as shown in FIG. 9(A), the rectifying means 44 of granular material may be supported by a porous plate 110 (as shown, the outlet hole 42 can be formed in the extended boss 112). The rectifying member 44 can be attached to the side wall 114 of the outlet box 40, leaving a gap g as shown in FIG. 9(B), or to the side wall 114 of the outlet box 40 (the lower end of which being fully opened for the outlet hole 42) as shown in FIG. 9(C). Further, the rectifying member can be constructed by piles of porous plates 116 as shown in FIG. 9(D).

Figure 10:
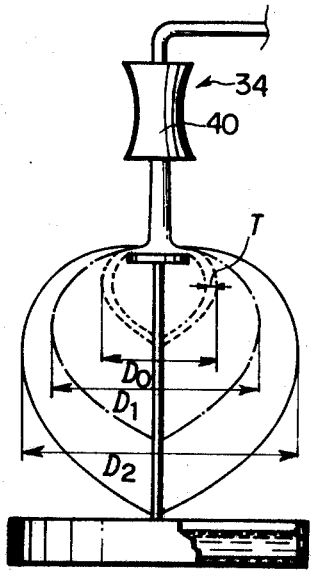
FIG. 10 is a partially cutaway side view explaining the size of globular or spheroidal fluid-film.
Figure 11:
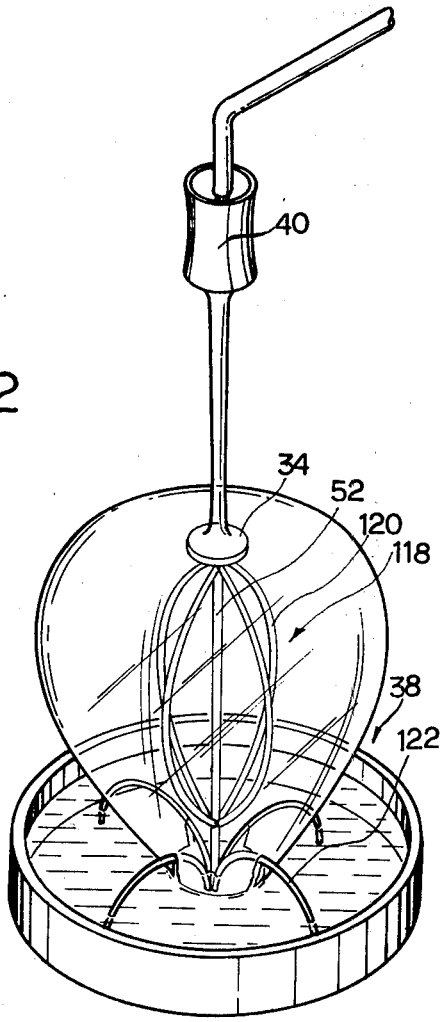
FIG. 11 is a perspective view showing an embodiment of a stabilizing means of the invention.
Figure 12:
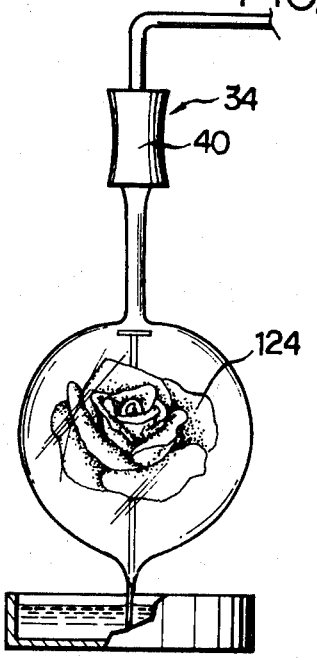
FIG. 12 is a partially cutaway front view showing another embodiment of a stabilizing means of the invention.
Figure 13:
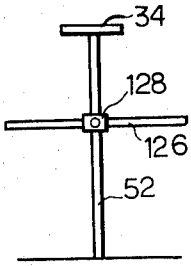
FIGS. 13, 14, 15 and 16 are partial diagrammatic views showing embodiments of the stabilizing means of the invention.
Figure 14:
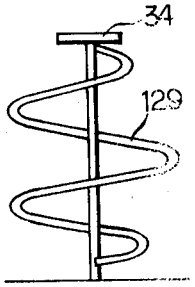
Figure 15:
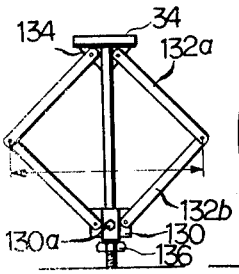
Figure 16:
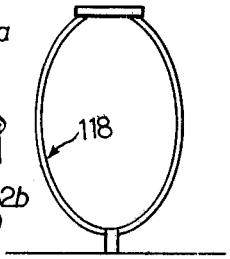
Figure 17:
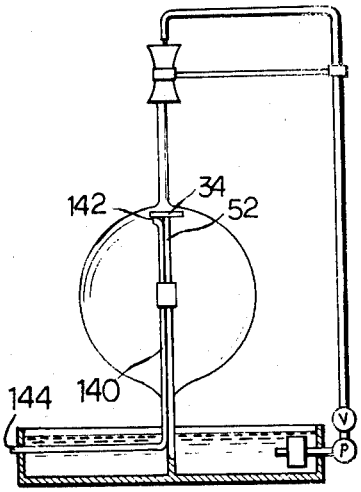
FIG. 17 is a partially cutaway side view showing a basic embodiment of a stabilizing means of pipe-type.

As mentioned earlier briefly, it is reasonable that the diameter of globe or spheroid formed on the expanding means should be enlarged, with the increasing of the quantity of fluid supplied per unit time. However, the curious phenomenon sometimes occurs in which the diameter remains as it is without reference to the increasing of the fluid. For example, even if the quantity of fluid poured from the outlet box 40 is doubled from W to 2W, the diameter of the fluid-film remains D1 (shown in chain line of FIG. 10 and it should be enlarged into D2 in solid line). On the other hand, regardless of how constant the quantity of fluid supplied on the expanding means, the formed fluid-film in a shape of globe or spheroid gradually diminishes in size, and at last forms itself into a small ball with a diameter D0 and wall thickness T (shown in dotted line in FIG. 10). The inventors found a stabilizing means 118 which is quite effective to preclude such phenomena. A stabilizing means, shown in FIG. 11, consists of some bowform rods 120 attached radially to the supporting rod 52 which supports the expanding means 34 and separated each other with almost equal circular pitch. The fluid poured from the outlet box 40 can be enlarged smoothly, since the lower end of the fluid-film gradually descends along the bowform rods 120, which include a portion formed at the lower end thereof for ventilating air. Preferably, additional bowform rods 122 may be installed in the supporting means 38 as shown in FIG. 11, which facilitate to form a larger fluid-film. Instead of the stabilizing means 38 consisting of bowform rods 120, 122, another stabilizing means 118 in various forms are also available. For example, in addition to a stabilizing means 118 comprising an artificial or natural flower 124 shown in FIG. 12 (other shapes of artificial or natural things or statues, e.g. a figure of animal or lady are also available), a stabilizing means 118 having crossed straight rods 126 projecting from a ring 128 secured to the supporting rod 52 shown in FIG. 13, or a stabilizing means 118 consisting of a helically wound rod 129 shown in FIG. 14 is also available for the same purpose. A stabilizing means 118 shown in FIG. 15 comprises vertically adjustable slider 130 with a lock bolt 130*a* and two to four or more pairs of rods 132*a*, 132*b*, one ends of each rods 132*a*, 132*b* being hinged each other, the other end of rod 132*b* being jointed to the adjustable slider 130 and the other end of rod 132*a* being hinged to a plate 134 welded under the expanding means 34, and as a result, the distance S between the hinged points can be varied at needs. Preferably, the adjustable slider 130 is moved vertically by means of screw pair 136. If necessary, the supporting rod 92 is removable, as shown in FIG. 16. FIG. 17 shows a stabilizing means 118 of different type which comprises a pipe 140, the upper end 142 thereof being opened just under the expanding means 34 and the other end 144 being opened at the position which is fully separated from the expanding means 34. The stabilizing means can pass air sufficiently between the inside of the fluid-film and the outside for preventing the aforesaid curious phenomena. In the stabilizing means of this type, it is preferable to send suitably pressurized air from the lower end 144 of the pipe 140 into the inside of fluid-film for displaying the ability of breathing. Further, this stabilizing means of the type can be employed for getting a better decorative apparatus, in which the globular or spheroidal fluid-film in different size are obtainable, by adjusting the pressure of air.

Figure 18:
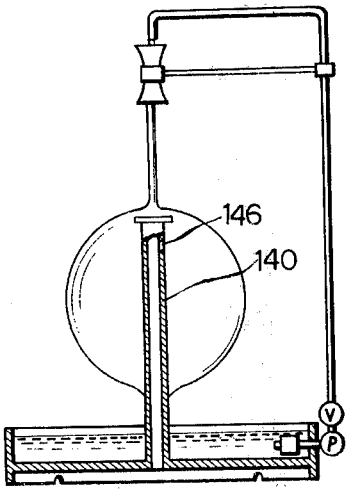
FIGS. 18, 19 and 20 are partially cutaway side views showing another embodiments of the stabilizing means of pipe-type.
Figure 19:
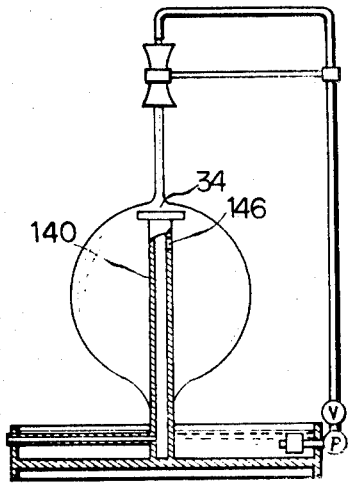
Figure 20:
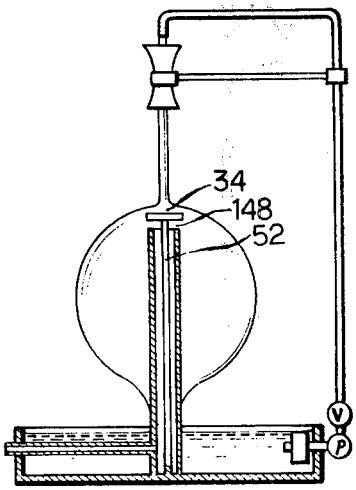
Figure 21:
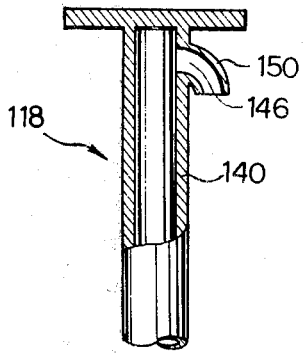
FIGS. 21 and 22 are partial diagrammatic sectional views showing the examples of protected holes which are adoptable in the stabilizing means of pipe-type.
Figure 22:
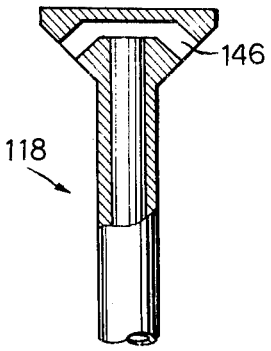

FIGS. 18 and 19 show the stabilizing means 118 comprising a pipe 140 formed with at least one hole 146, through which air in the fluid-film communicates with the outside air. In embodiments shown in FIGS. 18 and 19, the pipe 140 serves both as a supporting rod 52 (shown in FIG. 17) and as a stabilizing means 118. FIG. 20 shows a stabilizing means 118 having a pipe 140 surrounding a supporting rod 52 and having an opened top end. FIG. 21 shows a stabilizing means 118 formed with a hole 146 protected by a pent roof 150 in order to prevent the fluid from entering into the pipe 140 through the hole 146. FIG. 22 shows a stabilizing means formed with a downwardly inclined holes 146 for the same purpose.

Figure 23:
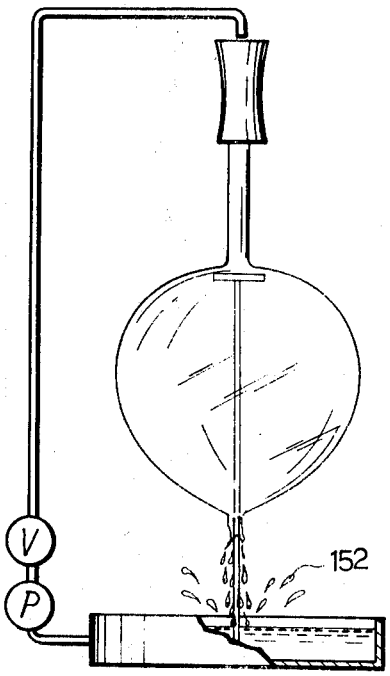
FIGS. 23 and 24 are partially cutaway side views showing a fluid-line onto which the lower end of fluid-film falls.
Figure 24:
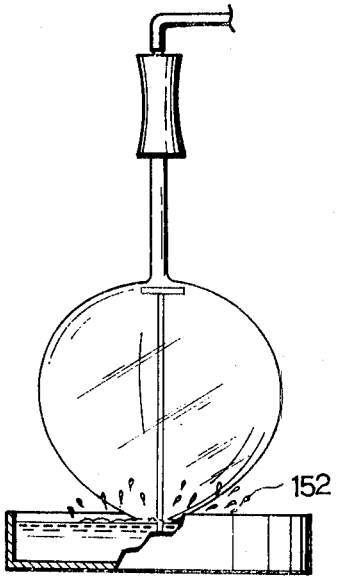
Figure 25:
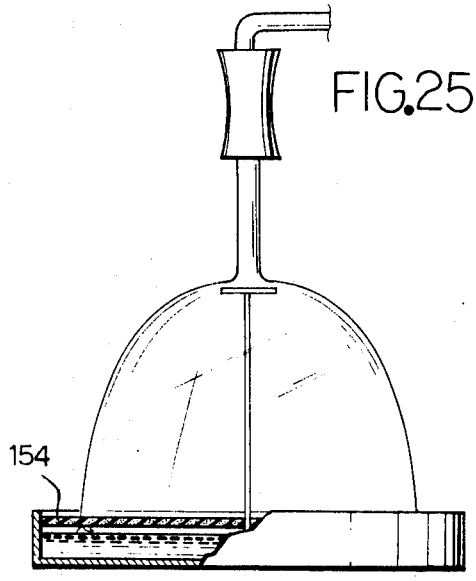
FIGS. 25, 26(A) and 26(B) are partially cutaway side views showing embodiments of soundproof means.
Figure 26A:
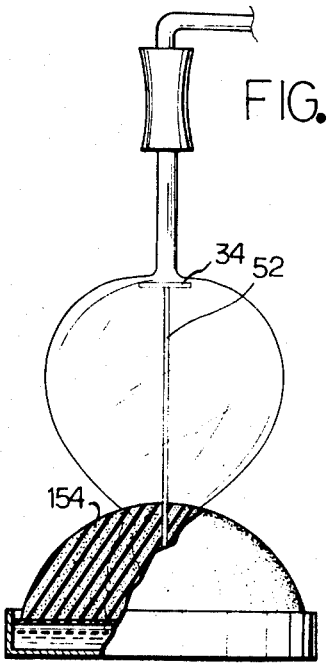
Figure 26B:
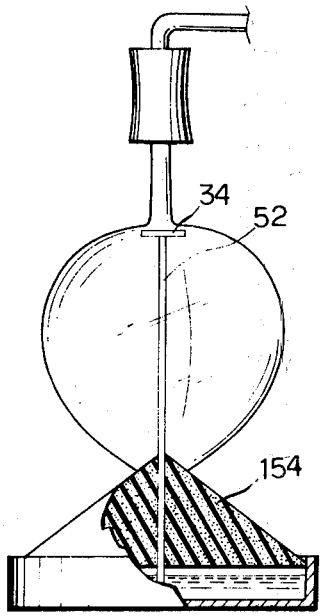

The lower end of the fluid-film falls onto the fluid-line directly or along the supporting rod 52, in a form of water-drop or fluid-film as shown in FIGS. 23 and 24, which produces a noise and splashes 152. FIGS. 25 to 27 show some examples of soundproof means 154 which can preclude such troubles effectively, as partially already shown with reference to the round plate 102 in the outlet means 32 shown in FIG. 6. In the example shown in FIG. 25, the soundproof means 154 (which can serve for an anti-splashing means, too) is a flat plate made of a porous material which is permeable to fluid. In addition to the aforesaid porous material, haired or furry sheet is also available as well as net material or granular material, which are already described with reference to the material for the rectifying member 44. Preferably, the soundproof means may be formed in a shape of hemisphere as shown in FIG. 26(A), or cone as shown in FIG. 26(B).

As mentioned earlier, the top surface 48 of the expanding means 34 may be formed in various shapes, without being restricted to the flat one.

Figure 27A:
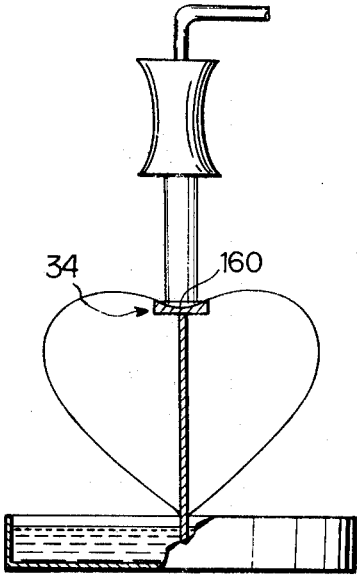
FIGS. 27(A), 27(B) and 28 are partially cutaway side views showing embodiments of the expanding means of the invention.
Figure 27B:
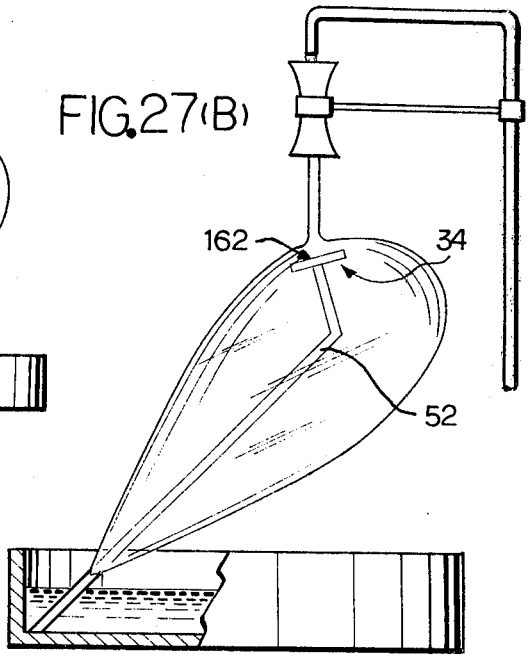
Figure 28:
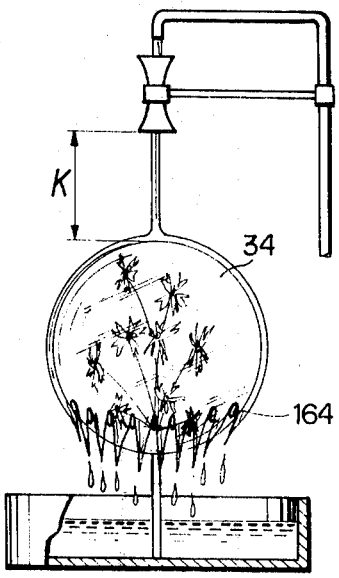

When the expanding means 34 has a concave surface 160 on the top thereof as shown in FIG. 27(A), a pretty and stable heart-shaped fluid-film is obtainable, on pouring down the regularized fluid. If the expanding means 34 has a inclined and flat surface 162 as shown in FIG. 27(B), a spheroidal fluid-film, which longitudinal axis being leaned, is formed around the supporting rod 52. When the expanding means 34 has a relatively large and three-dimensional surface, e.g. globe as shown in FIG. 28, by decreasing the distance K between the outlet hole 42 and the expanding means 34 and regularizing the fluid poured on the expanding means 34 by means of the aforesaid rectifying member, a transparent and invisible fluid-film with even thickness and smooth surface (without having any wave or wrinkle thereon) which flows down along the surface of the expanding means is obtainable, as shown in FIG. 28. This invisible fluid-film can be employed effectively for constructing a decorative apparatus of different type, for example, by employing an expanding means made of transparent material and equipped with some articles to be exhibited therein. It is preferable to form a disturbing means 164, e.g. holes, projections, grooves or the like therearound in order to disturb the fluid-film and to make visible the fluid-film. As a result, the beautiful apparatus as if the fluid-film suddenly appeared at the disturbing means is obtainable.

Figure 29:
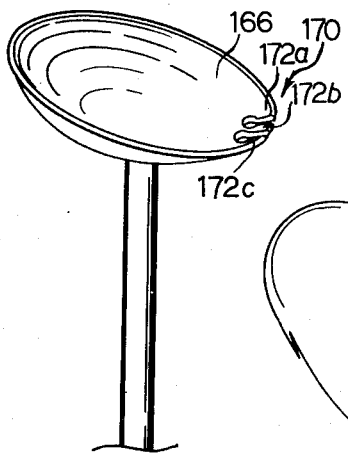
FIG. 29 is a perspective partial view showing an embodiment of the expanding means in a shape of spoon.
Figure 30:
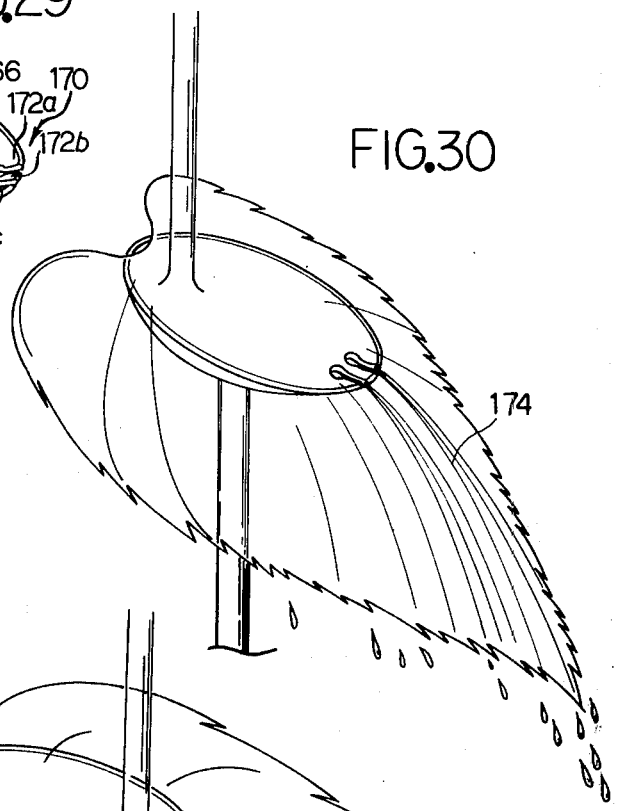
FIGS. 30 and 31 are perspective partial views showing the shape of the fluid-film formed by the expanding means shown in FIG. 29, FIGS. 32 and 33 are perspective partial views showing embodiments of the expanding means formed with the branching means and the shapes of fluid-film obtained thereby.
Figure 31:
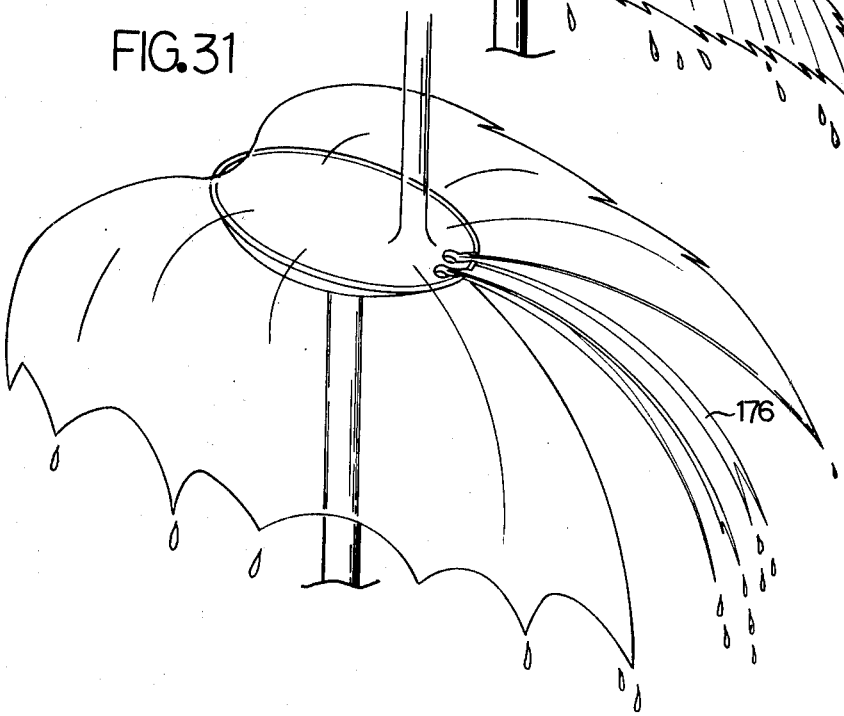

Further, when the expanding means is in a shape of spoon 166 (shown in FIG. 29) slightly inclined, a leaf-shaped fluid-film is obtainable, as shown in FIG. 30. Preferably, adjusting the angle of inclination of the expanding means and the position where the fluid is poured, a butterfly-shaped fluid-film can be formed therearound, as shown in FIG. 31. Further, changing the quantity of fluid poured onto the expanding means 34 cyclically, beautiful scenery as if the butterfly were fluttering about is obtainable. It is preferable to provide a branching means 170 on the top surface of the expanding means which can modify or cut slightly or partially the formed fluid-film consciously. One example is shown in FIG. 29. The branching means 170 which is projections or edges 172*a* to 172*c* in this embodiment can depict the veinings 174 additionally at the inside of the leaf as also shown in FIG. 30. In the case of the fluid-film shown in FIG. 31, the fluid which flows through between the projections or edges 172*a* to 172*c* takes a shape of a pair of tactile organ 176 of the aforesaid butterfly.

The branching means can be formed in various shapes and can be installed on various positions. FIG. 32 shows a round and flat expanding means 34 equipped with branching means 170 consisting of four short triangular columns 178*a* to 178*d*, separated each other with almost equal circular pitch. With the expanding means 34 shown in FIG. 32, a beautiful flower-shaped fluid-film with four petals is obtainable. Prior to the pouring down onto the expanding means 34, it is essential to regularize the fluid in order to form a stable and beautiful fluid-film. Using an expanding means shown in FIG. 33 formed with a branching means 170 comprising many projections 180, a birdcage-shaped fluid-film is obtainable, since individual flow which passes through each narrow passage between the projections 180 takes a form of such a vertical wire of the birdcage. Preferably, as shown in FIGS. 34 and 35, the expanding means having some expanding surfaces in different shapes can be installed rotatably (preferably intermittently). With the rotation of such expanding means 34, various fluid-films in different shapes are obtainable one by one.

Figure 42:
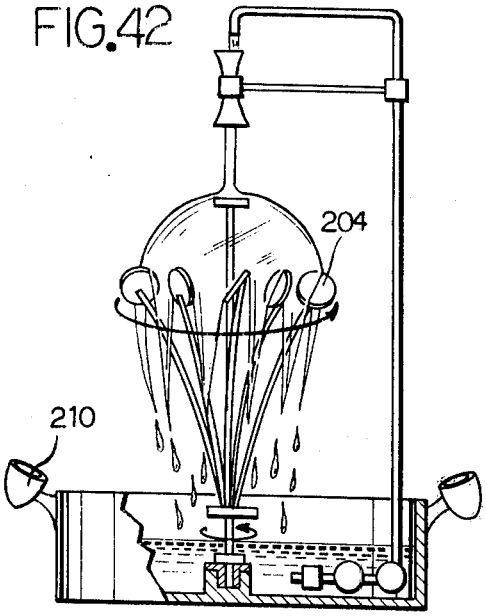
FIG. 42 is a partially cutaway side view showing further embodiment of the rotating means of the invention.

FIG. 36 shows another embodiment of the branching means 170 which is not formed on the top surface of the expanding means but connected to supporting means 38 through the suitable arm member 182. The cross section of the branching means 170 can be formed in various shapes, such as round, thin oval, diamond or the like as shown in FIGS. 37(A) to 37(F). Above all, branching means formed with sharp edge as shown in FIG. 37(C) and FIG. 37(F) which can cut the fluid-film fairly without disturbing excessively, is preferably available to obtain the beautiful fluid-film. Owing to the branching means shown in FIG. 36, flower-shaped fluid-film with petals or parasol-shaped fluid-film with fringes is obtainable. As shown in FIG. 38, the branching means 170 can be mounted at some steps in different heights. The branching means 170*a* at the top step can cut the formed fluid-film roughly, and the branching means 170*b*, 170*c* fixed at the downward steps cut the fluid-film step by step, whereby a multiply cut beautiful fluid-film is obtainable, as shown in FIG. 39. FIG. 40 shows the embodiment of the branching means 170 which is mounted on a rotating means 186. The rotating means 186 comprises a water wheel 188 extending from the ring 190 which is supported on the flange 192 through a bearing member 194, and an additional nozzle 196 facing to the water wheel 188 and being connected to a branch pipe diverging from the feed pipe 56. In operation, the fluid from the nozzle 196 rotates the water wheel 188 having the branching means 170, and as a result, a rotating fluid-film is obtainable. Instead of the construction comprising a nozzle 196 and a water wheel 188, a rotatable wing 200 extending from a ring 202 (the branching means 170 may be supported on the ring 202) connected to the supporting rod 52 and having an inclined plane 204, is available for the purpose. The fluid which falls on the inclined plane 204 can rotate the wing 200 gravitationally. The inclined planes can be formed at the branching means per se without employing an extra wing, as shown in FIG. 42. In order to rotate the branching means, any other suitable means, such as well known oil-motor or electric-motor is also available therefor. It is obvious that the similar rotating means is available for rotating only the aforesaid expanding means 34.

Figure 41:
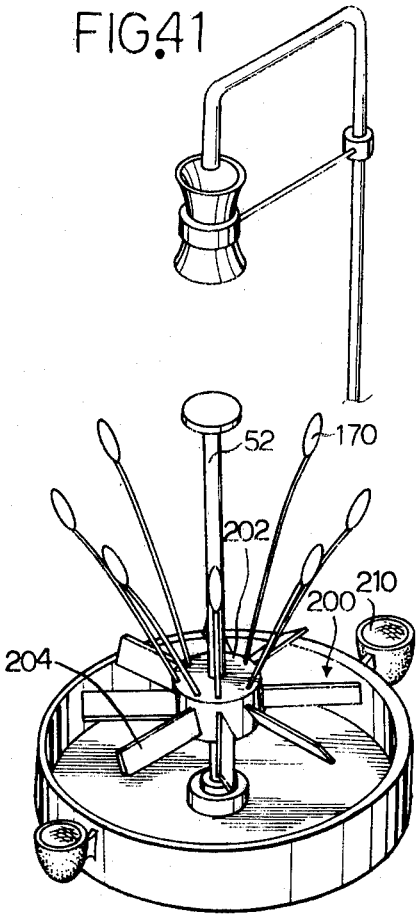
FIG. 41 is a perspective partial view showing another embodiment of a rotating means of the invention.

The decorative apparatus of the present invention, as will be recognized by a person skilled in the art, may be fabricated of any suitable material, for example, glass, plastics material, stainless metal or the like. In the case where the apparatus, especially the expanding means, outlet box, bowl and so on, is made of colored or transparent material, it is effective to illuminate it by means of a suitable illuminator 210 (illustrated in FIGS. 40 to 42) in order to get beautiful colored fluid-film. Further, when using a fluid containing fluorescent material, it is quite useful to employ an illuminator which can radiate ultraviolet rays, which results in providing an apparatus with visionary sense of beauty.

In the apparatus of the invention, it is necessary to use a suitable fluid having an adequate viscosity, no poisonous character and high flashing temperature. With respect to the viscosity of the fluid, the inventors have found that the suitable range of the viscosity is from 1 to about 100 cP, the upper being limited in viewpoint of the liquidity for passing through the rectifying member 44 and for pouring down through the outlet hole 42, and that the greater viscosity of the fluid, the better stability of the fluid-film is obtained. Therefore, in addition to the pure water, water mingled with suitable viscosity promoter such as triethylene glycol, polyethylene glycol, polypropylene glycol, glycerin, polyethylene oxide or the like, or fluid having suitable viscosity per se, for example, liquid paraffin, mineral oil or the like is available for the purpose.

What we claim is:

1. A decorative apparatus utilizing a filmy flow of fluid for producing a hollow form having a stable fluid film of smooth surface and generally uniform thickness comprising:

a supporting means, said supporting means including a storage means for storing said filmy fluid;

outlet means supported by said supporting means;

feed means for supplying said filmy fluid from said storage means to said outlet means; and expanding means positioned beneath said outlet means, said expanding means transforming said filmy fluid discharged from said outlet means into said hollow form, wherein the improvement comprises an improved outlet means, the improved outlet means comprising:

an outlet box, said outlet box including an outlet hole for discharging said filmy fluid and at least one air passage communicating to the atmosphere being positioned at an upper portion; and a rectifying means, said rectifying means comprising a porous fluid permeable member, wherein said rectifying member covers said outlet hole and the area of said rectifying member is substantially greater than the area of said outlet hole.

2. The decorative apparatus of claim 1, wherein said rectifying member is made of porous material which is permeable to the fluid.

3. The decorative apparatus of claim 2, wherein said porous material is a member selected from the group consisting of rubber sponge, synthetic resin sponge and natural sponge.

4. The decorative apparatus of claim 1, wherein said outlet box is formed with a narrow passage at deep position thereof, for removing air bubbles from the fluid.

5. The decorative apparatus of claim 1, wherein said fluid has a viscosity range of 1 to about 100 cP and is a member selected from the group consisting of water, water mingled with viscosity promoter, liquid paraffin and mineral oil.

6. The decorative apparatus of claim 5, wherein said viscosity promoter is a member selected from the group consisting of triethylene glycol, polyethylene glycol, polypropylene glycol, glycerin and polyethylene oxide.

7. The decorative apparatus of claim 1, wherein said expanding means possesses a branching means for modifying the formed filmy flow of fluid.

8. The decorative apparatus of claim 7, wherein said branching means comprises triangular short columns fixed near the edge of the expanding means and separated each other with almost equal circular pitch.

9. The decorative apparatus of claim 7, wherein said expanding means possessing the branching means is mounted on a rotating means.

10. The decorative apparatus of claim 1, wherein said supporting means is equipped with a branching means for modifying the formed filmy flow of fluid.

11. The decorative apparatus of claim 10, wherein said branching means is mounted on a rotating means.

12. The decorative apparatus of claim 11, wherein said rotating means comprises a wing attached around a supporting rod which supports the expanding means and is mounted on said supporting means and formed with an inclined surface, the wing being rotated owing to the gravitical force due to the gravity of fluid poured onto the inclined surface.

13. The decorative apparatus of claim 1, wherein said supporting means is equipped with a soundproof means for preventing the production of noise and fluid-splash.

14. The decorative apparatus of claim 13, wherein said soundproof means is made of porous material.

15. The decorative apparatus of claim 14, wherein said porous material is a member selected from the group consisting of rubber sponge, synthetic resin sponge and natural sponge.

16. The decorative apparatus of claim 13, wherein said soundproof means is in a shape of a flat plate.

17. The decorative apparatus of claim 13, wherein said soundproof means is in a shape of a cone.

18. The decorative apparatus of claim 13, wherein said soundproof means is in a shape of a hemispheroid.

19. The decorative apparatus of claim 1, wherein said supporting means is provided with a stabilizing means equipped under the expanding means for stabilizing the size of a filmy flow of fluid.

20. The decorative apparatus of claim 19, wherein said stabilizing means comprises bowform rods mounted radially with almost equal circular pitch under the expanding means.

21. The decorative apparatus of claim 19, wherein said stabilizing means is in a shape of natural article.

22. The decorative apparatus of claim 19, wherein said stabilizing means comprises a pipe means having at least one hole formed just under the expanding means and another hole spaced sufficiently from the expanding means.

23. The decorative apparatus of claim 1 wherein said rectifying member is not directly connected with the fluid supply.

* * * * *